United States Patent [19]

Blackmore

[11] Patent Number: 4,555,017

[45] Date of Patent: Nov. 26, 1985

[54] BALES OF BAGGED BATTS

[75] Inventor: Phillip W. Blackmore, Camlachie, Canada

[73] Assignee: Fiberglas Canada Inc., Toronto, Canada

[21] Appl. No.: 677,261

[22] Filed: Dec. 3, 1984

Related U.S. Application Data

[63] Continuation-in-part of Ser. No. 555,846, Nov. 28, 1983.

[30] Foreign Application Priority Data

Sep. 14, 1983 [CA] Canada ..... 436628

[51] Int. Cl.[4] ..... B65D 85/16; B65D 85/62; B65D 71/06

[52] U.S. Cl. ..... 206/83.5; 206/449; 206/585; 229/40

[58] Field of Search ..... 206/83.5, 321, 525, 206/499, 585, 449, 524.8, 45.33, 523; 229/40

[56] References Cited

U.S. PATENT DOCUMENTS

| | | | |
|---|---|---|---|
| 2,354,186 | 7/1944 | Donahue | 206/321 |
| 2,913,030 | 11/1959 | Fisher | 206/524.8 |
| 3,246,443 | 4/1966 | Slemmons | 206/523 |
| 3,327,449 | 6/1967 | Hullhorst et al. . | |
| 3,458,966 | 8/1969 | Dunbar et al. | 206/83.5 |
| 3,516,217 | 6/1970 | Gildersleeve | 206/499 |
| 3,681,092 | 8/1972 | Titchenal et al. | 206/45.33 |
| 3,747,743 | 7/1973 | Hoffmann, Jr. | 206/321 |
| 3,958,693 | 5/1976 | Greene | 206/524.8 |

*Primary Examiner*—William T. Dixson, Jr.
*Attorney, Agent, or Firm*—Robert F. Delbridge; Arne I. Fors

[57] ABSTRACT

A bale of elongated flexible bags of generally rectangular section each contains one or more batts of fibrous heat insulating material, the bags being aligned in a row with larger faces in mutual contact. A sleeve of flexible relatively non-extensible material having a width which is a substantial proportion of the length of the batts extends around the row of bags and retains the fibrous heat insulating material in a compressed state in which the uncompressed volume of the heat insulating material is reduced but which results in substantially full recovery to the uncompressed volume when the heat insulating material is removed from the bags after the wrapping sleeve has been removed.

4 Claims, 1 Drawing Figure

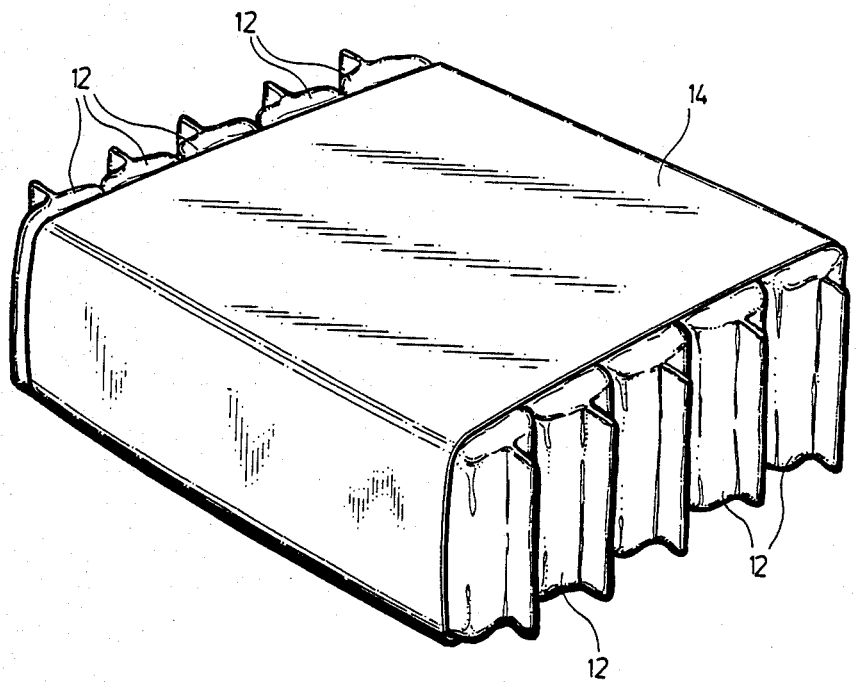
12
12
14
12
12

BALES OF BAGGED BATTS

This application is a continuation-in-part of application Ser. No. 555,846 filed Nov. 28, 1983.

The invention relates to a packaging of fibrous heat insulating material.

Fibrous heat insulating material, such as that sold under the Trade Marks FIBERGLAS and ROCKWOOD, is of comparatively low density, that is to say has a considerable volume compared to its weight. Since the cost of transporting a product from the manufacturer to its place of sale depends among other things on the space it occupies during transportation, the volume of fibrous heat insulating material tends to be a significant factor in its cost of transportation. Further, not only the volume of the material but also the ease or otherwise of handling the product affects transportation costs.

Fibrous heat insulating material is conventionally sold in elongated flexible bags of generally rectangular section containing a number (for example two or three) of lengths of material knows as batts, the packages usually being of strong paper or other bag-like material and being of such a size as to contain batts in a low-compressed state.

Attempts have been made to reduce transportation costs of such bags by compressing the bags to a reduced volume for transportation from place of manufacture to place of sale. Although such a procedure does indeed reduce transportation costs, another problem becomes evident, namely the fact that compression of fibrous heat insulating material beyond a certain limit results in the material being permanently deformed in shape to such an extent that its heat insulating properties are reduced to an undesirable degree. Also, such known procedures have resulted in handling and stacking difficulties.

It is therefore an object of the invention to provide a readily handlable and stackable fibrous heat insulating material package assembly which occupies a smaller amount of space than its normal volume, and yet which does not compress the material to a significantly non-recoverable extent.

According to the invention, a series of elongated flexible bags of generally rectangular section, each containing one or more batts of fibrous heat insulating material, are formed into a bale by aligning the bags in a row with their larger faces in mutual contact, compressing the row of bags to reduce the thickness of the bags and therefore the length of the row by an amount which permits the fibrous material in the bags to substantially recover its original size when such compression is removed, wrapping a length of relatively non-extensible flexible sheet-like material around the row of compressed bags, and securing opposite ends of the sheet-like material together to cause the sheet-like material to retain the compressed bags in assembly as a bale, the sheet of wrapping material having a width which extends over most of the length of the bags.

It has been found that, by wrapping the batt-containing bags in this manner, the amount of compression applied to the bags for transportation can readily be controlled to achieve compression which results in maximum volume reduction for transportation consistent with substantially full recovery to original volume when the heat insulating material is removed from the bags after the wrapping sleeve has been removed. Because the width of the sleeve extends over most of the length of the bags, the compression is supplied substantially evenly over the volume of the batts. Also, the application of such a sleeve enables the resulting bale to be of substantially rectangular section, thereby also facilitating handling and stacking.

The width of the wrapping sleeve is preferably at least 90% of the length of the bag, and the wrapping sleeve may be of paper, plastic or fibrous materials such as glass or jute.

One embodiment of the invention will now be described, by way of example, with reference to the accompanying drawing which shows a perspective view of a bale of bags containing batts of fibrous heat insulating material.

Referring to the drawing, the base comprises a series of elongated polyethylene bags 12 of generally rectangular section containing fibrous insulating material sold under the trade mark FIBERGLAS, there being five bags in this embodiment. Each bag may contain a variable number of batts depending on the thickness.

The bags 12 are aligned in a row with their larger faces in mutual contact, and a wrapping sleeve 14 of woven polypropylene is wrapped around the bags 12, while they are in a compressed state, to retain them in the configuration shown in the drawing, with the opposed ends (not shown) of the sleeve 14 being secured together in any convenient manner, for example by adhesive as will be readily apparent to a person skilled in the art, to retain the bags in the compressed state. The width of the sleeve 14 extends over substantially all the length of the bags 12, thereby providing even compression. It will be noted that the sleeve 14 forms the bags 12 into a bale of substantially rectangular section which is free-standing and can readily be handled and stacked. The bale does not require palletization, can be readily handled by a forklift or pallet truck, and is suitable for maximizing the use of space in a tractor trailer. Thus, freight costs are minimized.

If desired, the bale may contain more than one row of bags 12. For example, there may be two rows of bags one above the other (again referring to the orientation shown in the drawing).

The amount of compression of the bags 12 and hence of the batts of fibrous heat insulating material by the sleeve 14 is to a maximum degree for space saving consistent with substantially full recovery when the heat insulating material is removed from the bags 12 after the sleeve 14 has been removed. A suitable amount of compression in any particular instance can of course readily be determined by a person skilled in the art as a result of routine trial or experiment.

A typical bale may for example have a length of about 50 inches (about 125 cm), a depth (when oriented as shown in the drawing) of about 16 or 25 inches (40 or 60 cms), depending on the width of the batts, and a width of about 44 inches (110 cm).

Depending upon the specific nature of the fibrous heat insulation material, it has been found that the material may be compressed to a volume which is from about 5 to about 35% of its uncompressed volume. The material may be held under an initial amount of compression by its bag, i.e. before the wrapping sleeve is applied. The material is then held in a further compressed state by the wrapping sleeve when the wrapping sleeve has been applied around the bags to form the bale. For example, the material may be compressed to about 20% of its uncompressed volume in the bag, with the wrapping sleeve causing the material to be held under further compression to about 12% of its uncompressed volume.

Other embodiments and examples of the invention will be readily apparent to a person skilled in the art, the scope of the invention being defined in the appended claims.

What I claim as new and desire to protect by Letters Patent of the United States is:

1. A bale comprising elongated flexible bags of generally rectangular section, each containing one or more batts of fibrous heat insulating material, each bag retaining the fibrous heat insulating material therein in a low compressed state, the bags being aligned in a row with larger faces in mutual contact, and a sleeve of flexible relatively non-extensible wrapping material having a width which is a substantial proportion of the length of the batts, the wrapping sleeve extending around the row of bags and compressing the bags to retain the fibrous heat insulating material in a further compressed state in which the volume of the fibrous heat insulating material is further reduced but which is insufficient to prevent substantially full recovery of the fibrous heat insulating material to its uncompressed volume when the fibrous heat insulating material is removed from the bags after the wrapping sleeve has been removed.

2. A bale according to claim 1 wherein the width of the wrapping sleeve is at least 90% of the length of the bags.

3. A bale according to claim 1 wherein the wrapping sleeve is selected from the group consisting of glass fiber material, synthetic plastic material, paper and jute.

4. A bale according to claim 1 wherein the fibrous insulating material is compressed in the further compressed state to a volume which is from about 5 to about 35% of its uncompressed volume.

* * * * *